US006628061B2

(12) United States Patent
Hong et al.

(10) Patent No.: US 6,628,061 B2
(45) Date of Patent: Sep. 30, 2003

(54) ELECTRON GUN FOR CATHODE RAY TUBE

(75) Inventors: Young-gon Hong, Kyungki-do (KR); Min-cheol Bae, Kyungki-do (KR); Woo-seok Huh, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/988,231

(22) Filed: Nov. 19, 2001

(65) Prior Publication Data

US 2002/0067118 A1 Jun. 6, 2002

(30) Foreign Application Priority Data

Dec. 6, 2000 (KR) ..... 2000-73799

(51) Int. Cl.[7] ..... H01J 29/51; H01J 29/56; H01J 29/46

(52) U.S. Cl. ..... 313/446; 313/412; 313/414

(58) Field of Search ..... 313/446, 412, 313/413, 414, 426, 421, 427

(56) References Cited

U.S. PATENT DOCUMENTS 4,288,718 A * 9/1981 Blacker et al. ..... 313/414
4,457,733 A * 7/1984 Gioia et al. ..... 445/36
4,678,964 A 7/1987 Peels
5,006,754 A * 4/1991 Barten ..... 313/412
5,517,078 A * 5/1996 Sugawara et al. ..... 313/412
5,543,681 A * 8/1996 Jo ..... 313/414
5,625,252 A * 4/1997 Tsuzurahara et al. ..... 313/414
5,663,609 A * 9/1997 Kamohara et al. ..... 313/412
5,736,812 A * 4/1998 Park et al. ..... 313/413
5,808,406 A * 9/1998 Choi ..... 313/412
5,814,930 A * 9/1998 Watanabe et al. ..... 313/414
6,016,030 A * 1/2000 Amano et al. ..... 313/414
6,236,153 B1 * 5/2001 Kim ..... 313/414
6,255,767 B1 * 7/2001 Lee et al. ..... 313/414

FOREIGN PATENT DOCUMENTS

JP 2000-67774 3/2000

* cited by examiner

*Primary Examiner*—Sandra O'Shea
*Assistant Examiner*—Dalei Dong
(74) *Attorney, Agent, or Firm*—Leydig, Voit & Mayer, Ltd.

(57) ABSTRACT

An electron gun for a cathode ray tube includes a triode having cathodes, a first grid and a second grid, one or more third grids through which electron beams emitted from the cathode pass, a fourth grid opposing the third grids and forming a main focus lens with the third grid, a shield cup connected to the fourth grid and supplying a high voltage to the fourth grid, and a correction grid disposed between the fourth grid and the shield cup and having R, G, and B beam through holes arranged along a line. The R and B beam through holes have openings with asymmetrical shapes that are symmetrical with respect to each other and relative to the straight line, balancing astigmatisms and improving resolution.

7 Claims, 10 Drawing Sheets

ELECTRON GUN FOR CATHODE RAY TUBE

BACKGROUND OF THE INVENTION

1. Field of the Invention

The present invention relates to an electron gun and, more particularly, to an electron gun for a cathode ray tube (CRT) including a correction electrode having asymmetric beam through holes located between a grid having a single aperture and a shield cup.

2. Description of the Related Art

An electron gun for a color CRT generally includes a triode having cathodes, a first grid G1 and a second grid G2, a third grid G3 opposing the second grid G2 and forming a pre-focusing lens, a fourth grid G4 opposing the third grid G3 and forming a main lens, and a shield cup.

When power is applied to a cathode ray tube, the electron gun emits electron beams from the cathodes. The emitted electron beams are focused and accelerated while passing through apertures in a plurality of grids. The accelerated electron beams are selectively deflected by a deflection yoke installed on a cone portion of a bulb of the CRT and excite phosphors on a screen, thereby producing a displayed image. Electron guns have various structures for correcting errors in convergence of electron beams landing on peripheral parts of the screen due to the non-uniform deflecting magnetic field of the deflection yoke.

FIG. 1 is a horizontal sectional view showing an electron gun 10 disclosed in U.S. Pat. No. 5,517,078, FIG. 2A shows a third grid G3 shown in FIG. 1, and FIG. 2B shows a fourth grid G4 shown in FIG. 1. As shown in FIGS. 1, 2A, and 2B, the electron gun 10 includes three cathodes, KR, KG, and KB, first through fourth grids, G1 through G4, sequentially arranged in the direction of a phosphor screen, and a convergence cup Cp on the fourth grid G4. In the third grid G3 shown in FIG. 2A, three beam through holes 31R, 31G, and 31B are arranged along a straight line on a surface opposing the fourth grid G4.

Among the beam through holes 31R, 31G, and 31B of the third grid G3, the center beam through hole 31G has a circular shape. However, each of the side beam through holes 31R and 31B has an elongated shape, elongated in a horizontal direction, that is, the X-axis direction, of the third grid G3. Opposite edges of each of the side beam through holes 31R and 31B are arcs A1 and A2, respectively having radii R1 and R2. The arcs A1 and A2 are connected to each other with straight edges L1 and L2. The length of the inner arc A1 toward the center beam through hole is greater than that of the outer arc A2.

The fourth grid G4, shown in FIG. 2B, includes three beam through holes 41R, 41G, and 41B, arranged along a straight line on a surface opposing the third grid G3. The beam through holes 41R, 41G, and 41B of the fourth grid, G4, are all circular. Among these beam through holes 41R, 41G, and 41B, side beam through holes 41R and 41B are slightly off-center, outwardly in the arrangement direction of the three electron beams, by a distance ΔS with respect to the side beam through holes 31R and 31B of the third grid G3.

In the electron gun 10 having the described configuration, side beam through holes having inner and outer arcs of different lengths are located on at least one of the surfaces of the third grid G3 and the fourth grid G4 that face each other. Each of the third grid G3 and the fourth grid G4, forming a main lens, has three beam through holes. Thus, when forming asymmetric side beam through holes 31R and 31B, the effective individual aperture is reduced, thereby increasing spherical aberration. The main lens is very sensitive to alignment during assembly of the electron gun 10. The described grid configuration cannot ensure reliability of the electron gun 10. Also, minute adjustment of convergence is difficult.

FIG. 3 is a longitudinal sectional view of an electron gun 30 disclosed in U.S. Pat. No. 4,678,964. Referring to FIG. 3, the electron gun 30 includes three cathodes 31*a*, 31*b*, and 31*c*, a first grid 32, a planar second grid 33, a third grid 34, and a fourth grid 35. The third grid 34 includes cup-shaped parts 34*a* and 34*b* having open ends fixedly sealed to each other. The fourth grid 35 includes three beam through holes 35*a*, 35*b*, and 35*c*. Also, the fourth grid 35 further includes a cup-shaped field correction element 36 having rectangular beam through holes 36*a*, 36*b*, and 36*c*. The beam through holes 36*a*, 36*b*, and 36*c* of the field correction element 36 face the beam through holes 35*a*, 35*b*, and 35*c*. The field correction element 36 has a flange 36*d* connecting the fourth grid 35 and a sleeve 37.

The field correction element 36 is installed inside the fourth grid 35 and the beam through holes 36*a*, 36*b*, and 36*c* are vertically or horizontally elongated. Alternatively, the field correction element 36 is part of the grids 34 and 35, each of which has three beam through holes. Accordingly, the effective individual aperture is reduced, exhibiting a weak astigmatism correction. Because of the weakness of the correction, the improvement in distortion of beam spots at the peripheral portion of the screen is insufficient.

FIG. 4A is a front view of an electrode 40 disclosed in Japanese Unexamined Patent Application 2000-67774, FIG. 4B is a plan view of FIG. 4A, and FIG. 4C is a side view of FIG. 4A. In FIGS. 4A, 4B, and 4C, the electrode 40 is located between grids and a shield cup. The electrode 40 has three circular beam through holes 42, 43, and 44 arranged along a straight line on a planar portion 41. Perpendicular portions 45 and 46 are located at opposite edges of the planar portion 41. The electrode 40 has sloping portions 47.

The plate-shaped electrode is installed in the rear of a main lens for horizontal focusing and vertical divergence for improving performance of a quadrupole lens. However the electrode 40 is not reliable because it has perpendicular portions. Also, it is quite difficult to overcome the distortion of beam spots caused by side beam through holes 42 and 44.

SUMMARY OF THE INVENTION

To achieve the above object, there is provided an electron gun for a cathode ray tube including a triode having cathodes, a first grid, and a second grid; at least one third grid having a single aperture through which R, G, and B electron beams emitted from the cathodes commonly pass; a fourth grid opposing the third grid and forming a main focus lens with the third grid; a shield cup connected to the fourth grid and supplying a high voltage to the fourth grid; and a correction grid disposed between the fourth grid and the shield cup and having R, G, and B beam through holes with respective centers lying along a first line, the R and B beam through holes having respective openings that are asymmetrical about respective second lines, transverse to the first line, and passing through the centers of the R and B beam through holes, respectively.

Each of the R and B beam through holes of the correction grid may have an inner part near the center G beam through hole side that is longer than an outer part at the opposite side of the R and B beam through holes.

The R and B through holes may have edges describing trapezoidal openings.

The correction grid may have a planar surface facing the fourth grid and sloping surfaces facing the shield cup so that the correction grid has a thinnest part at the G beam through hole and becomes thicker, along the first line, toward each of opposite ends of the correction grid.

The correction grid may be a plate in which circular R, G, and B beam through holes are arranged along a straight line, and members for varying the openings of the R and B beam through holes are mounted on the plate blocking part of the R and B beam through holes, respectively.

According to another aspect of the invention, an electron gun for a cathode ray tube comprises a triode having cathodes, a first grid, and a second grid; at least one third grid through which R, G, and B electron beams emitted from the cathodes pass; a fourth grid opposing the third grid, forming a main focus lens; and a shield cup connected to the fourth grid and supplying a high voltage to the fourth grid and including R, G, and B beam through holes with respective centers lying along a first line, the R and B beam through holes having openings that are asymmetrical about respective second lines, transverse to the first line, and passing through the centers of the R and B beam through holes, respectively.

According to a third aspect of the invention, an electron gun for a cathode ray tube includes a triode having cathodes, a first grid, and a second grid; at least one third grid through which R, G, and B electron beams emitted from the cathodes pass; a fourth grid opposing the third grid and forming a main focus lens with the third grid; a shield cup connected to the fourth grid and supplying a high voltage to the fourth grid; and a correction grid disposed between the fourth grid and the shield cup and having R, G, and B beam through holes with respective centers lying along a first line, wherein the R and B beam through holes have respective trapezoidal openings that are symmetrical about the first line and asymmetrical about respective second lines, transverse to the first line, and passing through the centers of the R and B beam through holes, respectively.

According to a fourth aspect of the invention, an electron gun for a cathode ray tube includes a triode having cathodes, a first grid, and a second grid; at least one third grid through which R, G, and B electron beams emitted from the cathodes pass; a fourth grid opposing the third grid and forming a main focus lens with the third grid; a shield cup connected to the fourth grid and supplying a high voltage to the fourth grid; and a correction grid disposed between the fourth grid and the shield cup, and comprising a plate having circular R, G, and B beam through holes with respective centers lying along a first line, wherein the R and B beam through holes have respective openings in the correction grid that are asymmetrical about respective second lines, transverse to the first line, and passing through the centers of the R and B beam through holes, respectively, and the correction grid further includes members covering parts of the R and B beam through holes and mounted on the plate to produce the openings.

BRIEF DESCRIPTION OF THE DRAWINGS

The above objects and advantages of the present invention will become more apparent by describing in detail preferred embodiments with reference to the attached drawings in which.

DETAILED DESCRIPTION OF THE INVENTION

Figure 1:
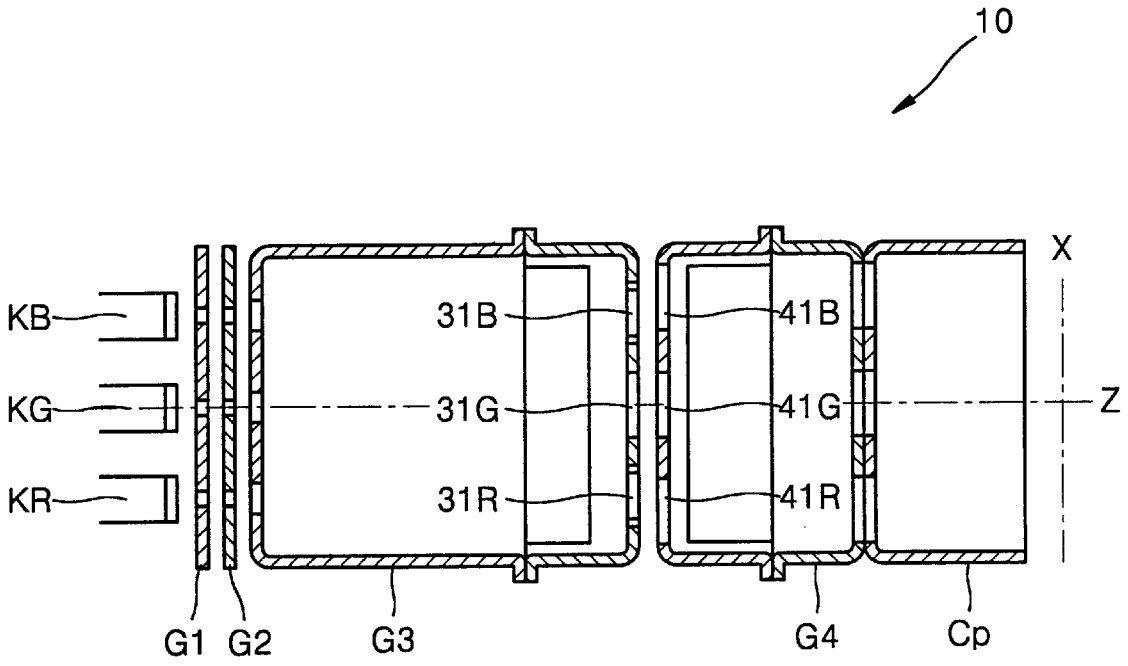
FIG. 1 (PRIOR ART)
FIG. 1 is a sectional view showing the arrangement of a first conventional electron gun.
Figure 2A:
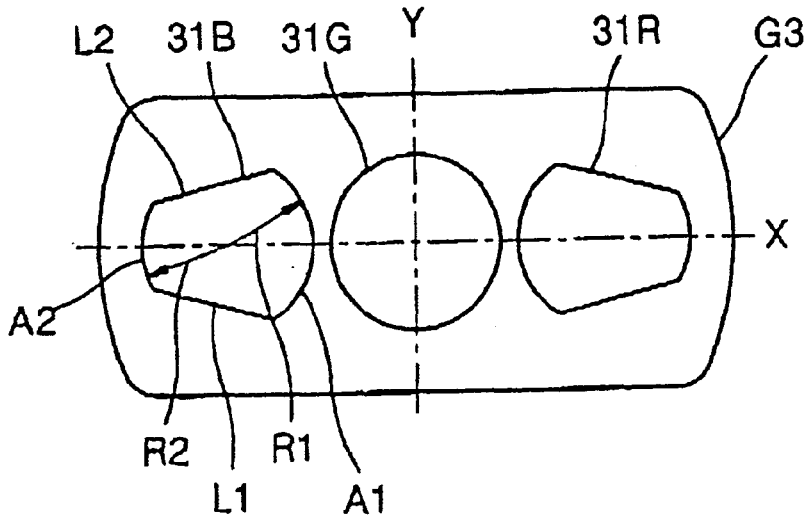
FIG. 2A (PRIOR ART)
FIG. 2A is a front view of a third grid shown in FIG. 1.
Figure 2B:
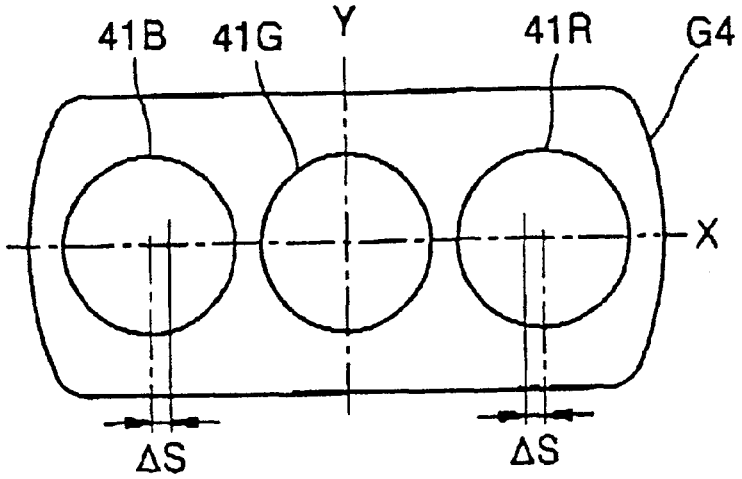
FIG. 2B (PRIOR ART)
FIG. 2B is a front view showing a fourth grid shown in FIG. 1.
Figure 3:
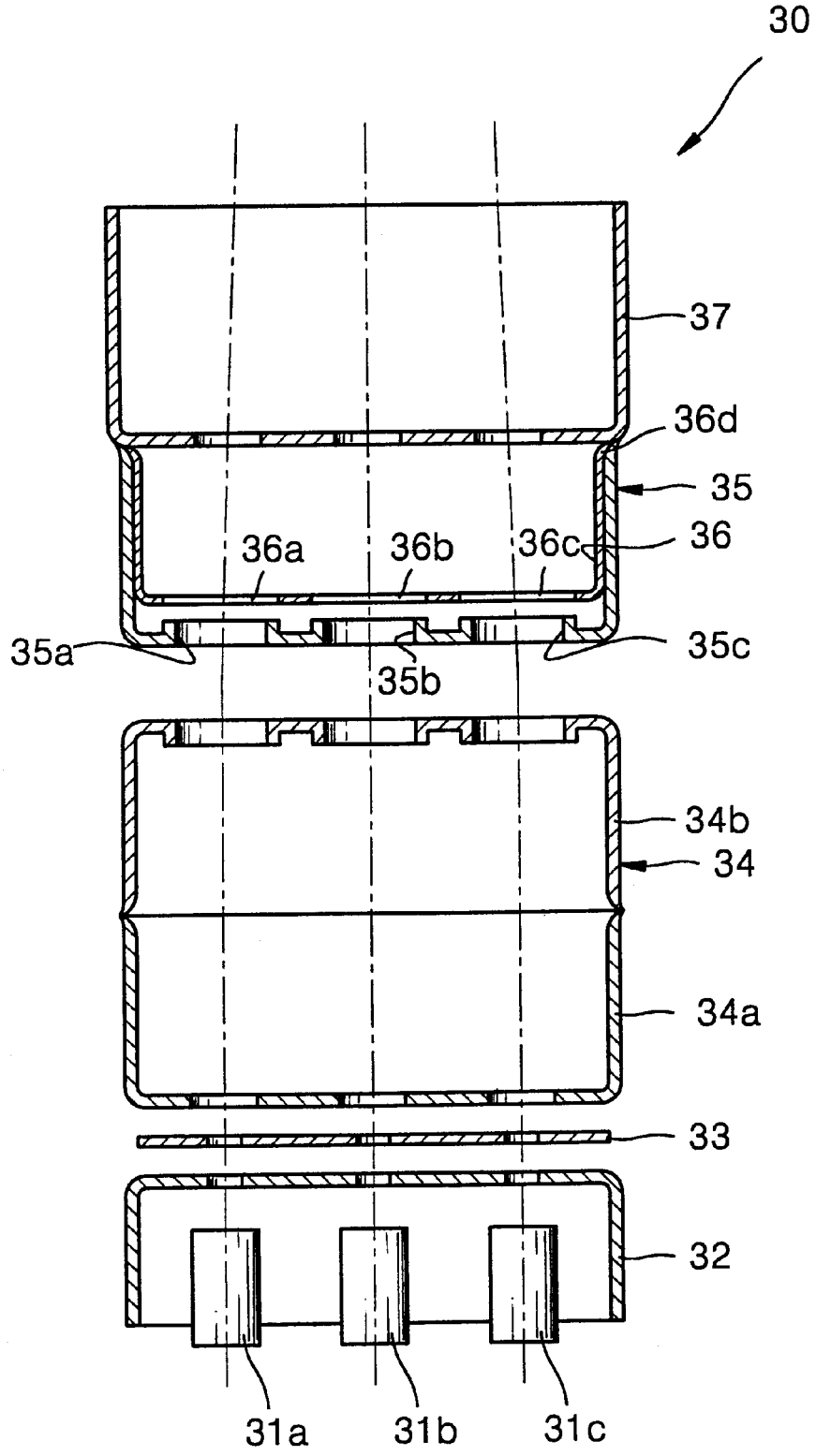
FIG. 3 (PRIOR ART)
FIG. 3 is a sectional view of a second conventional electron gun.
Figure 4A:
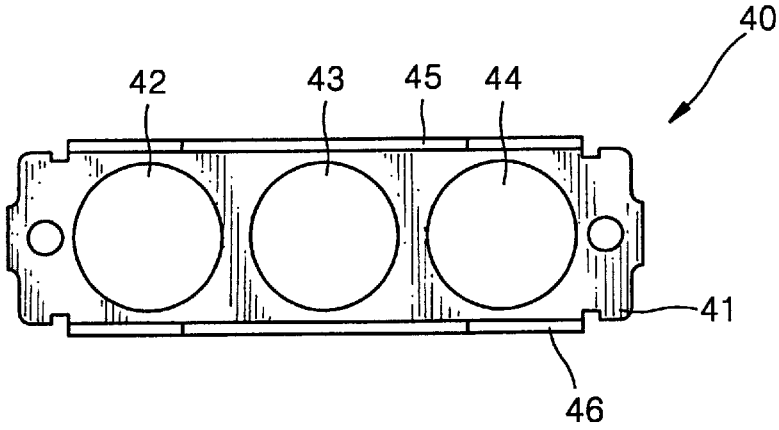
FIG. 4A (PRIOR ART)
FIG. 4A is a front view of a planar electrode of a third conventional electron gun.
Figure 4B:
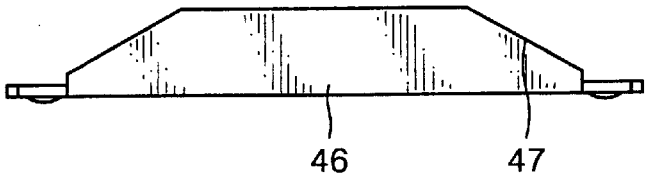
FIG. 4B (PRIOR ART)
FIG. 4B is a plan view of the electrode of FIG. 4A.
Figure 4C:
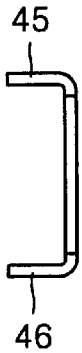
FIG. 4C (PRIOR ART)
FIG. 4C is a side view of the electrode of FIG. 4A.
Figure 5:
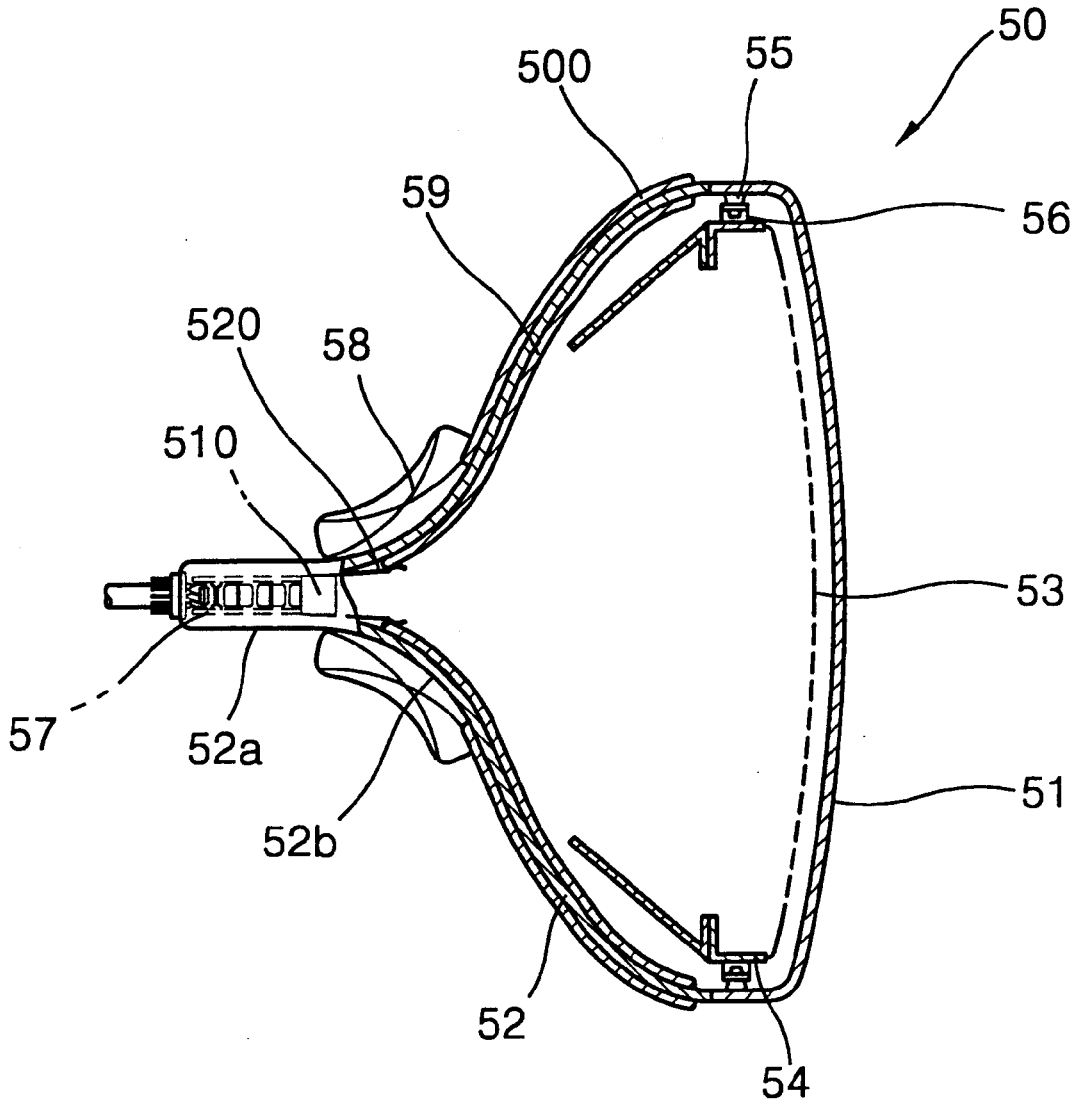
FIG. 5 is a sectional view showing a CRT according to the present invention.

As shown in FIG. 5, a CRT 50 includes a panel 51 having a phosphor screen on its inner surface, a funnel 52 integrally sealed to the panel 51, and a shadow mask 53 in which a large number of beam through holes are formed at an interval, located inward with respect to the panel 51. The shadow mask 53 is connected to a shadow mask frame 54 and fixed to the inner surface of the panel 51 by a stud pin 55 and a hook spring 56, so that it remains at a fixed position inside the panel 51. An electron gun 57 for emitting electron beams is sealed inside a neck portion 52*a* of the funnel 52, and a deflection yoke 58 for deflecting electron beams is installed on a cone portion 52*b* of the funnel 52. An interior graphite layer 59 and an outer graphite layer 500 coat the inner and outer surfaces of the funnel 52, respectively, as a condenser for stabilizing a high voltage applied to an anode using the funnel 52 made of glass as the insulating, i.e., dielectric material of the condenser.

The electron gun 57 includes a triode having cathodes, a first grid and a second grid, a plurality of third grids opposite the second grid and forming a pre-focus lens, and a fourth grid opposite the third grids and forming a main focus lens. A shield cup 510 is located in the front of the electron gun 57 through which electron beams exit the electron gun. A plurality of bulb spacers 520 are welded to the outer surface of the shield cup 510. The bulb spacers 520 elastically contact the interior graphite layer 59 to supply grids of the electron gun 57 with a positive voltage.

In the present invention, beam through holes in the opposing surfaces of the grids forming the main focus lens include a single aperture, and a correction grid having asymmetric openings is located between one of grids forming the main focus lens and the shield cup 510.

Figure 6:
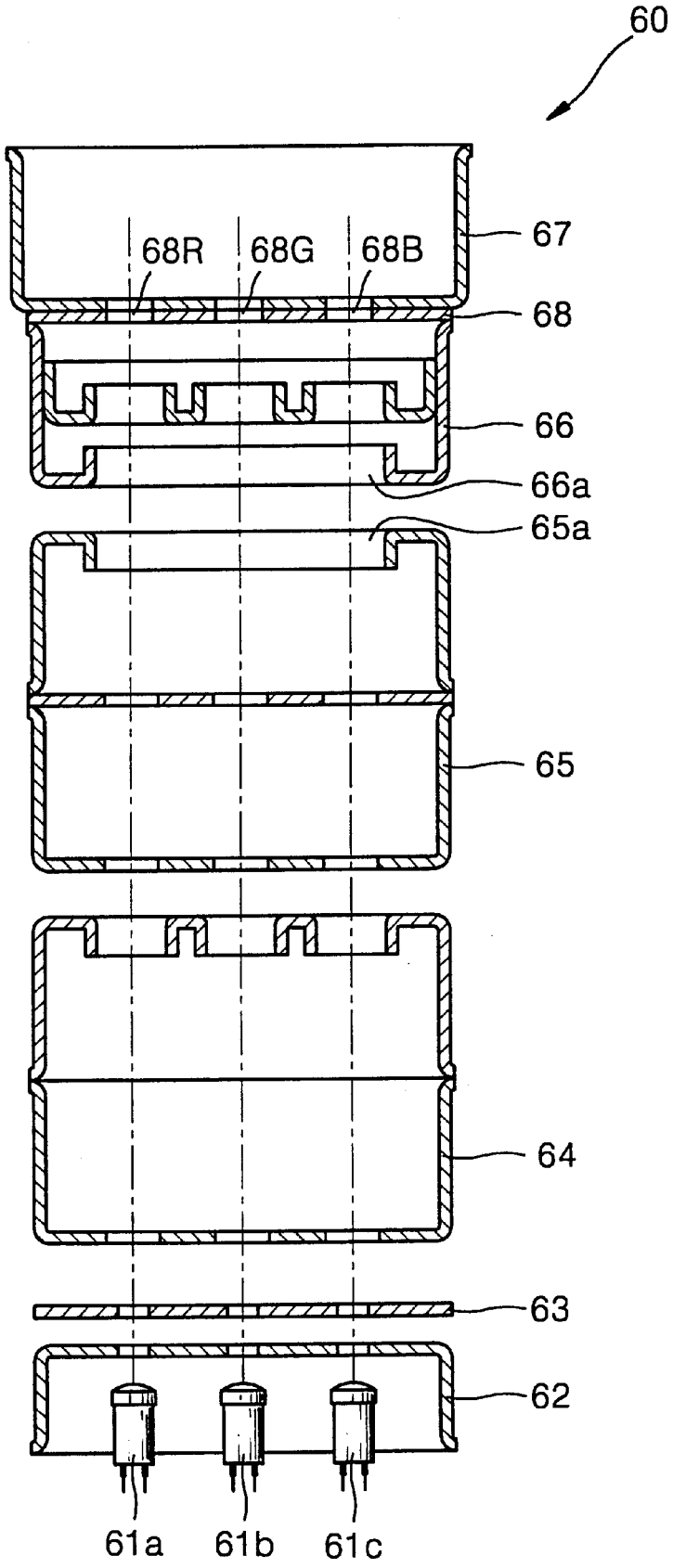
FIG. 6 is a sectional view showing an electron gun according to the present invention.
Figure 7:
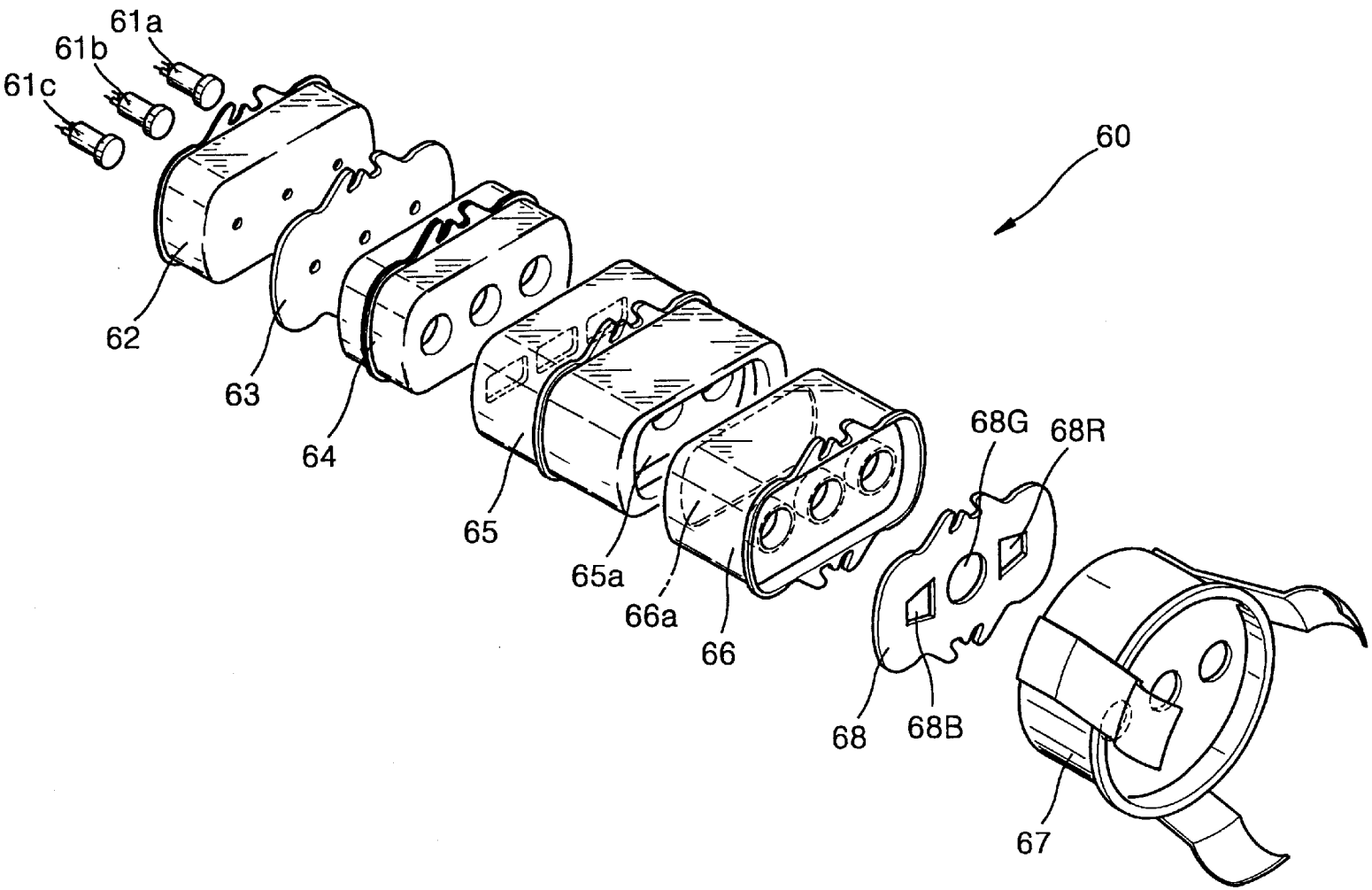
FIG. 7 is an exploded perspective view of the electron gun of FIG. 6.

FIG. 6 is a sectional view showing an electron gun 60 according to the present invention and FIG. 7 is an exploded perspective view of the electron gun of FIG. 6. The electron gun 60 includes a triode having three cathodes 61*a,* 61*b,* and 61*c,* as thermionic electron sources, a first grid 62 for controlling the quantity of electrons emitted from the cathodes 61*a,* 61*b,* and 61*c* that flow toward the screen, using an external signal, and a second grid 63 located in front of the first grid 62. The electron gun 60 also includes a third grid 64 opposite the second grid 63 and forming an electron lens for focusing and accelerating electron beams, a fourth grid 65, and a fifth grid 66 located in the vicinity of the fourth grid 65 and forming a main focus lens. A shield cup 67 for high-voltage supply is mounted on the fifth grid 66.

In the electron gun 60, the number of focusing grids is not limited to the number illustrated and may increase in an electron lens unit for focusing electron beams in multiple steps. Each grid includes three beam through holes through which electron beams for exciting R, G, and B phosphors are arranged in a straight line. The opening, i.e., shape, of each of the beam through holes may vary according to the dimension of the electron lens unit formed between each of the respective grids. Alternatively, an electron lens unit may include a single aperture, through which three electron beams commonly pass, in a grid. The grid is welded to a bead glass (not shown) located on opposite sides of the electron gun 60 in the neck portion of a bulb.

According to an aspect of the present invention, a beam through hole 65*a* is located on the exit surface of the fourth grid 65 for forming a main focus lens and another beam through hole 66*a* is located on the entering surface of the fifth grid 66, opposite the fourth grid 65, respectively, so that R, G, and B electron beams commonly pass through holes 65*a* and 65*b*. According to another aspect of the present invention, a correction grid 68 having three beam through holes, 68R, 68G, and 68B, is interposed between the fifth grid 66 and the shield cup 67.

Figure 8:
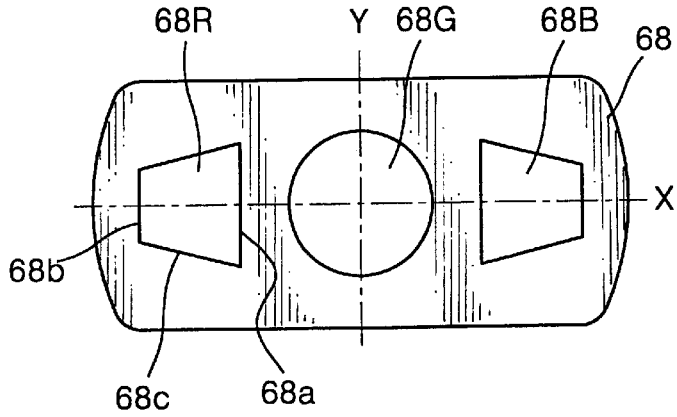
FIG. 8 is a front view showing a correction grid according to a first embodiment of the present invention.

As shown in the embodiment of FIG. 8, the G beam through hole 68G located in the center of the correction grid 68 has a circular shape. Each of the R and B beam through holes 68R and 68B located at opposite sides of the G beam through hole 68G has an asymmetrical opening to prevent electron beams from being distorted at the peripheral portion of a screen, as now described for the R beam through hole 68R.

The shape of the R beam through hole 68R is defined by an inner edge 68*a,* the edge nearest the G beam through hole 68G, and an outer edge 68*b* opposite the inner part 68*b* and most remote from the G beam through hole 68G. Edges 68*a* and 68*b* are straight, vertical, i.e., perpendicular to the straight line on which the centers of the beam through holes 68R, 68G, and 68B are located, and parallel. The inner and outer edges 68*a* and 68*b* have different lengths and are connected by oblique edges 68*c*. The length of the inner part 68*a* is relatively longer than that of the outer part 68*b* in the vertical direction of the correction grid 68, that is, the Y-axis direction.

The R beam through hole 68R has an opening that is trapezoidal and, therefore, has an asymmetric deflecting portion for convergence correction. The B beam through hole 68B has an opening with the same trapezoidal shape as the R beam through hole 68R and is symmetrically arranged at the opposite side of the G beam through hole from the R beam through hole.

As described above, in the electron gun 60 employing the correction grid 68, having asymmetric beam through holes 68R and 68B located between the fifth grid 66 and the shield cup 67, the electron beams, having passed through the fourth grid 65 forming a main focus lens with the fifth grid 66, are prevented from being distorted at the peripheral portion of the screen.

Figure 9A:
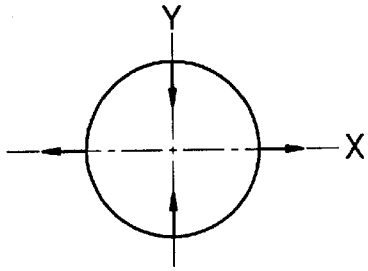
FIG. 9A is a graphical representation of lens components of side beams of a fourth grid shown in FIG. 6.
Figure 9B:
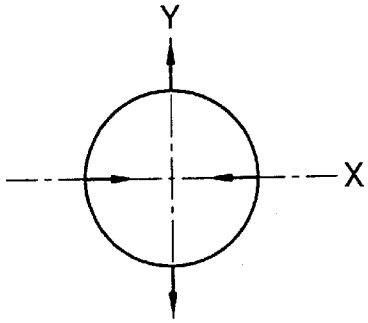
FIG. 9B is a graphical representation of lens components of side beams of a fifth grid shown in FIG. 6.
Figure 9C:
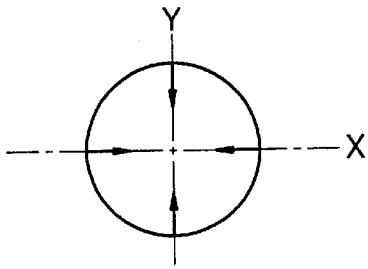
FIG. 9C is a graphical representation of synthesized lens components shown in FIGS. 9A and 9B.

FIGS. 9A through 9C show the correcting effect produced by the correction grid 68. Referring to FIGS. 7 and 9A through 9C, side electron beams diverge horizontally, i.e., in the X-axis direction, and are focused vertically, i.e., in the Y-axis direction, while passing through a beam through hole 65*a* in the exit surface of the fourth grid 65 (see FIG. 9A). Also, the side electron beams are focused horizontally and diverge vertically while passing through a beam through hole 66*a* in the entering surface of the fifth grid 66 (see FIG. 9B).

In this case, the electron beams diverge at a predetermined angle due to the effect of a pin-cushion-shaped magnetic field, resulting in degradation of the resolution at the peripheral portion of a screen. The degradation of the resolution is removed by using the correction grid 68. Lens components acting on the side beams shown in FIGS. 9A and 9B are synthesized and represented by vectors, as shown in FIG. 9C. Accordingly, the side electron beams have respective apertures that cause them to have a circular shape at the peripheral portion of the screen, thereby improving resolution. The circular shape is produced because the lengths of the inner edge 68*a* and the outer edge 68*b* of the R and B beam through holes 68R and 68B are different so that the openings of the R and B beam through holes 68R and 68B of the correction grid 68 produce asymmetrical electric fields.

In other words, when electron beams are deflected by non-uniform magnetic fields consisting of a pin-cushion-shaped horizontal deflection magnetic field and a barrel-shaped vertical deflection magnetic field generated by the deflection yoke, the lens component acts on the electron beam passing through the R beam through hole 68R in a direction which compensates the pin-cushion-shaped deflection magnetic field at one side of the neck portion of the CRT. Conversely, the lens component acts on the electron beam passing through the B beam through hole 68B in the direction compensating the pin-cushion-shaped deflection magnetic field at the other side of the neck portion. Accordingly, left and right astigmatism imbalance at the screen periphery is overcome, improving resolution.

Figure 10:
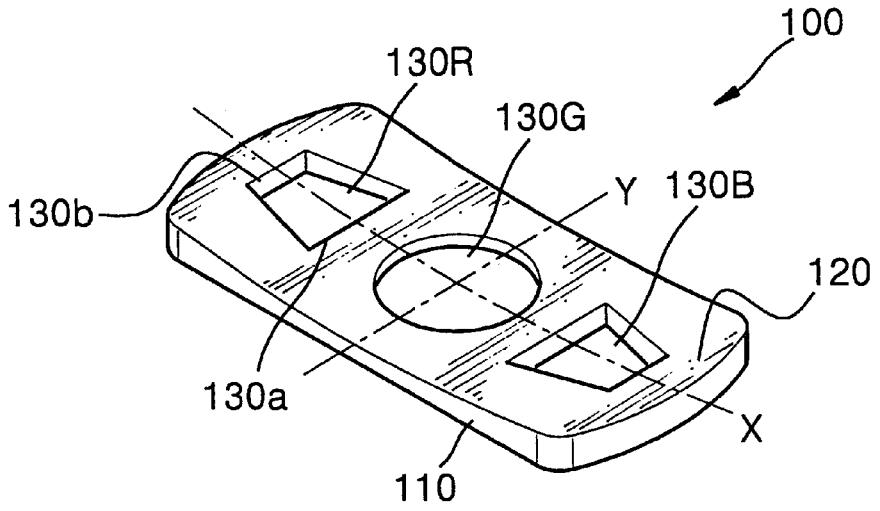
FIG. 10 is a perspective view of a correction grid according to a second embodiment of the present invention.
Figure 11:
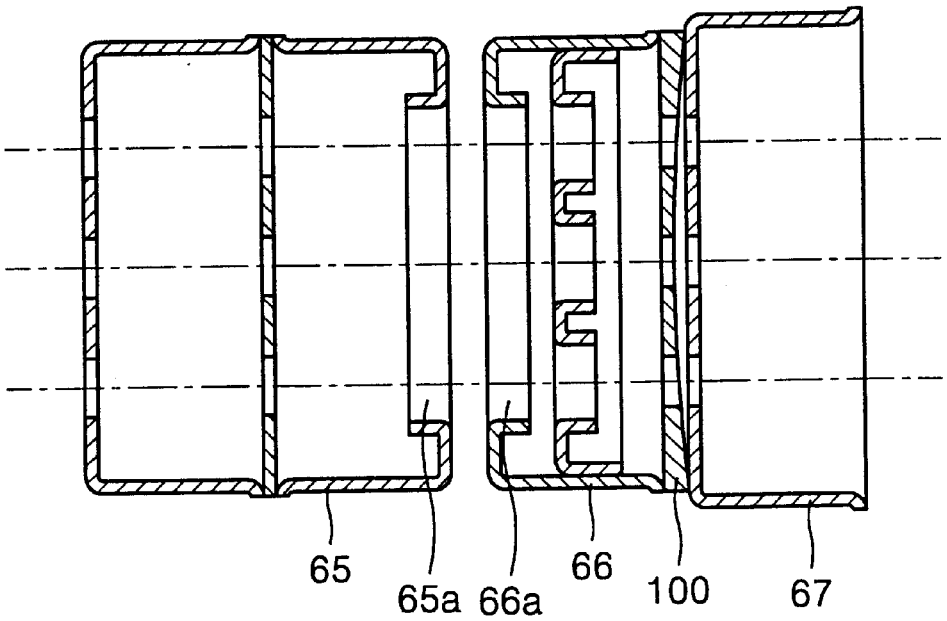
FIG. 11 is a sectional view showing a portion where the correction grid shown in FIG. 10 is installed.

FIG. 10 is a perspective view of a correction grid 100 according to a second embodiment of the present invention, and FIG. 11 is a longitudinal sectional view showing where the correction grid shown in FIG. 10 is located in the electron gun. The same reference numerals as those shown in the other drawings denote the same members. Referring to FIGS. 10 and 11, the correction grid 100 is disposed between the fifth grid 66, opposite the fourth grid 65, and the shield cup 67. The correction grid 100 has a planar side 110 at the exit surface of the fifth grid 66 and a sloping surface 120 at a portion contacting the shield cup 67. The sloping surface 120 is sloped from the center of the correction grid 100 toward the ends of the correction grid 100. In other words, the correction grid 100 varies in thickness and has a thinnest central portion. The thickness of the correction grid 100 increases gradually toward the ends of the correction grid along the X-axis, i.e., along the straight line passing through the centers of the R, G, and B beam through holes.

In the correction grid 100, three R, G, and B beam through holes 130R, 130G, and 130B are arranged along a straight line in the X-axis direction. Among the beam through holes 130R, 130G, and 130B, the center G beam through hole 130G has a circular shape and opening. Each of the side R and B beam through holes 130R and 130B have trapezoidal openings with different lengths of inner and outer edges 130*a* and 130*b*, in order to form an asymmetrical electric field, the action of which has already been described with reference to FIG. 8 and so a repeated explanation is not necessary.

Figure 12:
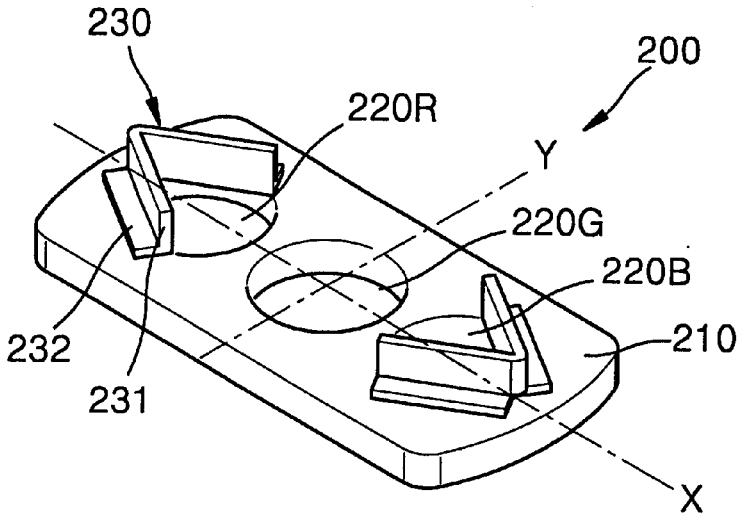
FIG. 12 is a perspective view of a correction grid according to a third embodiment of the present invention.

FIG. 12 is a perspective view of a correction grid 200 according to a third embodiment of the present invention. Referring to FIGS. 7 and 12, the correction grid 200 is disposed between the fifth grid 66 and the shield cup 67. In the correction grid 200, R, G, and B beam through holes 220R, 220G, and 220B are arranged along a straight line of a planar main section 210. Among the beam through holes 220R, 220G, and 230B, the center G electron through hole 220G has a circular shape and opening. Each of the side R and B beam through holes 220R and 230B also has a circular hole but, in order to form an asymmetrical electric field, variable members 230 covering a part of each of the holes and changing the opening shape are mounted on the correction grid 200.

Each variable member 230 includes a plate 231 that is perpendicular to the main section 210 of the correction grid 200 and a shield section 232 at the lower end of the plate 231. The main section 210 covers parts of outer arcs of the circular side beam through holes 220R and 220B. The shield section 232 is preferably V-shaped and symmetrical about the horizontal center axis of the side beam through holes 220R and 220B, i.e., the line on which centers of the R, G, and B through holes lie. Accordingly, the side beam through holes 220R and 220B have asymmetrical openings.

Figure 13:
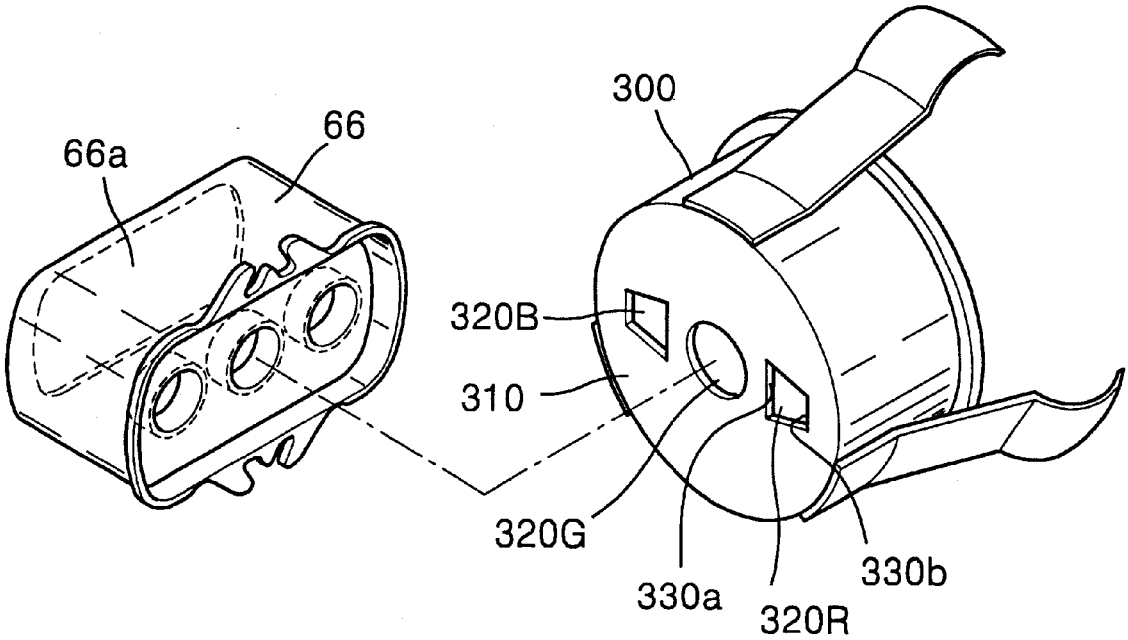
FIG. 13 is a perspective view of a correction grid according to a fourth embodiment of the present invention.

FIG. 13 is a perspective view of a correction grid according to a fourth embodiment of the present invention. Referring to FIG. 13, unlike the other embodiments described above, according to this embodiment, beam through holes 320R, 320G and 320B having two asymmetrical openings are directly made in a shield cup 300. In other words, the centers of the R, G, and B beam through holes 320R, 320G, and 320B are arranged in a straight line in a bottom surface 310 of the shield cup 300, opposite the exit surface of the fifth grid 66. Among the beam through holes 320R, 320G, and 330B, the center G electron through hole 320G has a circular opening, while the side R and B beam through holes 320R and 330B have polygonal openings in which each inner edge 330*a* is longer than each outer edge 330*b*.

In all embodiments, the openings of the R and B beam through holes are symmetrical about the straight line on which the centers of the R, G, and B beam through holes lie. The R and B beam through holes are symmetrically located relative to the G beam through hole and are symmetrical about an axis passing through the centers of the G beam through hole and transverse to the line on which the centers of the R, G, and B beam through holes lie. However, the R and G beam through holes have openings that are asymmetrical about lines passing through the centers of the R and B beam through holes and transverse to the straight line on which the centers of the R, G, and B beam through holes lie.

As described above, since, among in-line electron beam through holes, left and right side beam through holes 320R and 320B have asymmetrical openings, the lens component of the electron beam acts in a direction compensating a pin-cushion-shaped deflecting field when the electron beam is deflected by a deflection yoke toward the peripheral portion of a screen, so that focusing action becomes stronger horizontally and divergence becomes stronger vertically. That is to say, in consideration of the effect of remnant magnetic fields occurring upon deflection, the openings of electron beam through holes of a correction grid are asymmetrical in a direction in which a difference in the horizontal and vertical astigmatisms can be relatively compensated at the peripheral portion of the screen.

As described above, in the electron gun for a CRT according to the present invention, R and B beam through holes with asymmetrical openings are located between a fifth grid and a shield cup, thereby preventing distortion of electron beams by adjusting the aberration of an electronic lens unit at a peripheral portion of a screen and by horizontally and vertically adjusting the angle of incidence of electron beams due to the non-uniform magnetic fields of the deflection yoke. Accordingly, the resolution of a picture image is improved.

While this invention has been particularly shown and described with reference to preferred embodiments, it will be understood by those skilled in the art that various changes in form and details may be made therein without departing from the spirit and scope of the invention as defined by the appended claims.

What is claimed is:

1. An electron gun for a cathode ray tube comprising:

a triode having cathodes, a first grid, and a second grid;

at least one third grid having a single aperture through which R, G, and B electron beams emitted from the cathodes commonly pass;

a fourth grid opposing the third grid and forming a main focus lens with the third grid;

a shield cup connected to the fourth grid and supplying a high voltage to the fourth grid; and a correction grid disposed between the fourth grid and the shield cup and having R, G, and B beam through holes, wherein the R, G, and B beam through holes have respective centers lying on a first straight line, the R and B beam through holes have respective trapezoidal shapes that are asymmetrical about respective second straight lines, transverse to the first straight line, and passing through the centers of the R and B beam through holes, respectively, and the trapezoidal shapes of each of the R and B beam through holes have respective inner edges near the G beam through hole, parallel to the second straight lines, and longer than respective outer edges of the R and B beam through holes that are further from the G beam through hole than the inner edges and that are parallel to the second straight lines.

2. The electron gun of claim 1, wherein the correction grid has a planar surface facing the fourth grid and sloping surfaces facing the shield cup so that the correction grid has a thinnest part at the G beam through hole and becomes thicker, along the first line, toward each of opposite ends of the correction grid.

3. The electron gun of claim 1, wherein the correction grid is part of the fourth grid and is in contact with the shield cup.

4. The electron gun of claim 3, wherein the correction grid has a planar surface facing the fourth grid and sloping surfaces facing the shield cup so that the correction grid has a thinnest part at the G beam through hole and becomes thicker, along the first line, toward each of opposite ends of the correction grid.

5. An electron gun for a cathode ray tube comprising:

a triode having cathodes, a first grid, and a second grid;

at least one third grid having a single aperture through which R, G, and B electron beams emitted from the cathodes commonly pass;

a fourth grid opposing the third grid and forming a main focus lens with the third grid;

a shield cup connected to the fourth grid and supplying a high voltage to the fourth grid; and a correction grid disposed between the fourth grid and the shield cup and having R, G, and B beam through holes, the correction arid including a plate, wherein, the R, G, and B beam through holes have respective centers lying on a first straight line, the R and B beam through holes have respective shapes that are asymmetrical about respective second straight lines, transverse to the first line, and passing through the centers of the R and B beam through holes, respectively, the R, G, and B beam through holes include respective circular holes in the plate, and the R and B beam through holes have, in part, a V-shape symmetrical with respect to the first straight line and defined by respective members, each member including a shield section partially covering the circular holes in the plate of the R and B beam through holes and mounted on the plate to produce the V-shape of the R and B beam through holes, with widest portions facing the G beam through hole.

6. An electron gun for a cathode ray tube comprising:

a triode having cathodes, a first grid, and a second grid;

at least one third grid through which R, G, and B electron beams emitted from the cathodes pass;

a fourth grid opposing the third grid, forming a main focus lens; and a shield cup connected to the fourth grid and supplying a high voltage to the fourth grid and including R, G, and B beam through holes, wherein the R, G, and B beam through holes have respective centers lying on a first straight line, the R and B beam through holes have respective trapezoidal shapes that are asymmetrical about respective second straight lines, transverse to the first straight line, and passing through the centers of the R and B beam through holes, respectively, and the trapezoidal shapes of each of the R and B beam through holes have respective inner edges near the G beam through hole, parallel to the second straight lines, and longer than respective outer edges of the R and B beam through holes that are further from the G beam through hole than the inner edges and that are parallel to the second straight lines.

7. The electron gun of claim 6, wherein the third grid includes a single aperture through which the R, G, and B electron beams commonly pass to reduce spherical aberration by reducing magnification of a lens formed by the third grid and the fourth grid.

* * * * *